US006907995B1

(12) United States Patent
Tähkänen

(10) Patent No.: US 6,907,995 B1
(45) Date of Patent: Jun. 21, 2005

(54) CHIP SCREENING METHOD AND PLANT

(75) Inventor: Hannu Tähkänen, Florence, AL (US)

(73) Assignee: Valmet Woodhandling Oy, Pori (FI)

( * ) Notice: Subject to any disclaimer, the term of this patent is extended or adjusted under 35 U.S.C. 154(b) by 0 days.

(21) Appl. No.: 09/719,229

(22) PCT Filed: Jun. 28, 1999

(86) PCT No.: PCT/FI99/00569

§ 371 (c)(1),
(2), (4) Date: Feb. 9, 2001

(87) PCT Pub. No.: WO00/02671

PCT Pub. Date: Jan. 20, 2000

(30) Foreign Application Priority Data

Jul. 9, 1998 (FI) ..... 981578

(51) Int. Cl.[7] ..... B07B 1/00
(52) U.S. Cl. ..... 209/244; 209/257
(58) Field of Search ..... 222/108; 209/10, 209/256, 257, 258, 259; 244/256; 234/257, 258, 259; 241/24.2, 24.21, 24.29, 80; 162/55

(56) References Cited

U.S. PATENT DOCUMENTS 4,043,901 A * 8/1977 Gauld ..... 209/10
4,235,707 A * 11/1980 Burke, Jr. ..... 162/21
4,266,413 A 5/1981 Yli-Vakkuri
4,396,501 A * 8/1983 Morey ..... 209/10
4,927,534 A 5/1990 Riihimaki
5,203,965 A * 4/1993 McCowan ..... 162/142
5,232,097 A 8/1993 Tohkala
6,170,667 B1 * 1/2001 Bilak et al. ..... 198/670

FOREIGN PATENT DOCUMENTS

WO 8402093 6/1984

OTHER PUBLICATIONS

SCAN–CM 40:94 (Scandanavian Pulp, Paper and Board Testing Committee) Wood chips for pulp production (Rev. 1994).

* cited by examiner

*Primary Examiner*—Donald P. Walsh
*Assistant Examiner*—Joseph Rodriguez
(74) *Attorney, Agent, or Firm*—Burns, Doane, Swecker & Mathis, LLP

(57) ABSTRACT

A chip screening method and plant wherein the pin chips (9) are separated from the rest of the chips and dosed among chips that are to be led to a subsequent process (7) so that the share of the pin chips (9) relative to the total amount of chips (7) does not exceed a desired value. After the screening process, a desired amount of pin chips (20) is dosed among the chips that are to be led to a subsequent process (7) without intermediate storage.

5 Claims, 7 Drawing Sheets

CHIP SCREENING METHOD AND PLANT

BACKGROUND AND SUMMARY

This invention relates to the screening of wood chips and, especially, to the removal of the pin chips and to the dosing of them back into the process.

The objective of the chip screening is to free the chips from such shares of small-size and large-size fractions that could have a detrimental effect on the pulp making process. In the screening process, the large-size fractions (too big and too thick chips) are usually treated by means of a rechipper, for example, into smaller particles or crushed by means of a roller so press into a form more suitable for the process. The finest fraction (the sawdust) causes problems in most processes, which is why every effort is made to purify the chips from it as well as possible. The next biggest fraction, the so-called pin chips, as such, constitutes quite a good raw material in terms of fibres, but a high content of pin chips is disadvantageous to some processes, e.g. to continuously operating digesters, as it may cause malfunctions in the process (e.g. blocks).

For the removal of pin chips, the same kind of devices are used as for the removal of sawdust, i.e. flat screens, vibrating screens, roll screens, disc screens and so forth. To the screening elements themselves, however, changes are made because of the larger particle size. Screening plants known in the prior art are described, for example, in Finnish patent specifications 79251 and 90019. If the subsequent process (a chemical or a mechanical pulp making process) sets strict restrictions on the maximal amount of pin chips, and if it is possible that the pin content of the material to be fed is high, the pin chips are usually separated by screening and stored in a separate bin. Then, the pin chips are dosed into the accepted fraction fed to the subsequent process, using a constant ratio. The plants designed for this purpose are reliable as such but represent, from an economical point of view, a considerable extra investment. On an average, the amount of pin chips among the chips to be screened is usually larger than the allowable amount, especially when the chips are bought from sawmills. The method according to the invention provides the same result at substantially lower costs. The pin chips are separated in the screening process but a maximum desired amount is dosed back among the chips due for the process immediately after the separation. Thus, no intermediate storage of the pin chips, and, consequently, no pin bin with auxiliary devices are needed in the method according to the invention. The screening can be optimised.

BRIEF DESCRIPTION OF THE DRAWINGS

The invention and the details thereof will now be described in more detail with reference to the following drawings wherein.

DETAILED DESCRIPTION

Figure 1:
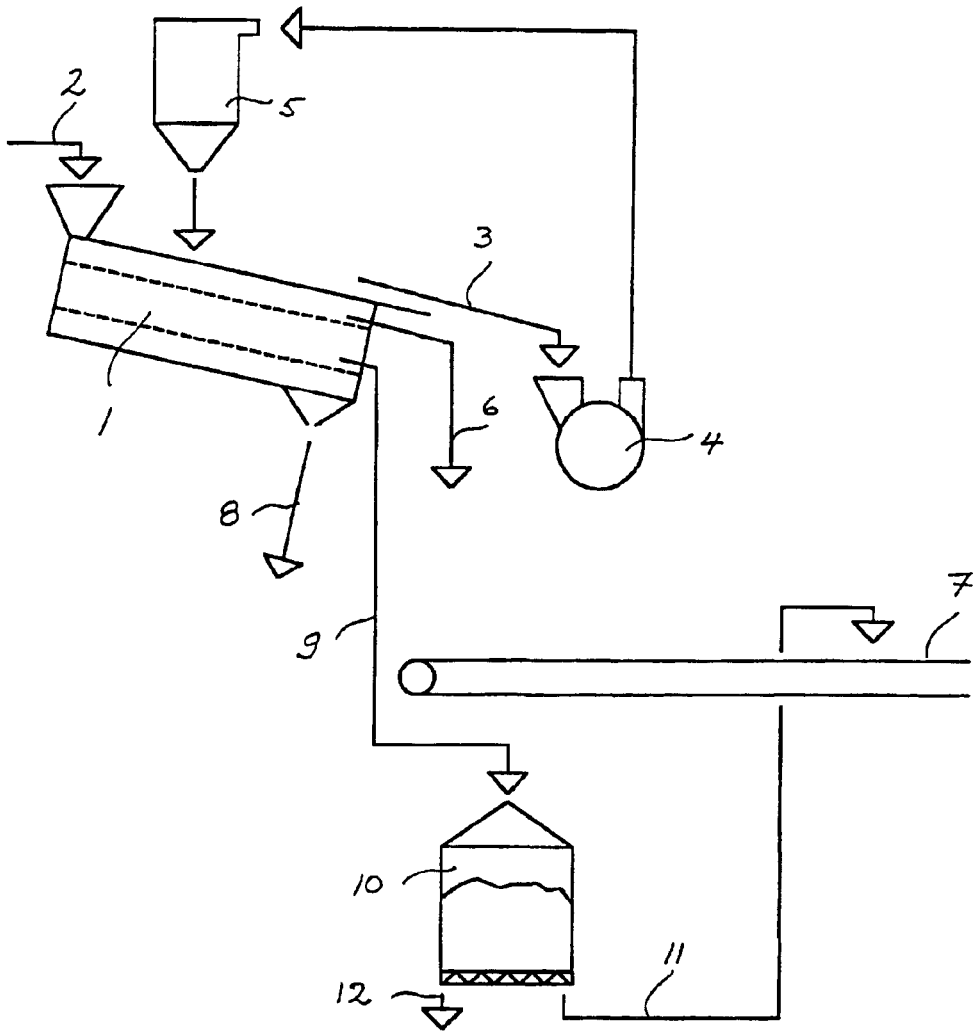
PRIOR ART Fig. 1
FIG. 1 shows the traditional way of separating and dosing pin chips using a flat screen.

FIG. 1 shows a screening system for separating pin chips and for re-dosing them so that the amount of pin chips among the chips that are to be led to the subsequent process remains constant. A flat screen 1 divides the input 2 into four parts. The large-size fraction 3 is led to a rechipper from which, once the re-chipping has been completed, it is conducted back to screen 1 via an air separating cyclone 5. The accepted fraction 6 is led to the subsequent process 7. The finest material 8, i.e. the sawdust, is usually led to a burning process. The pin chips 9 are conducted into a pin bin 10 from which a pin chip flow 11 of desired size is dosed back into the subsequent process 7. When the pin bin 10 becomes full, the pins are discharged from the bin among the sawdust 12, for example, to be burned.

Figure 2:
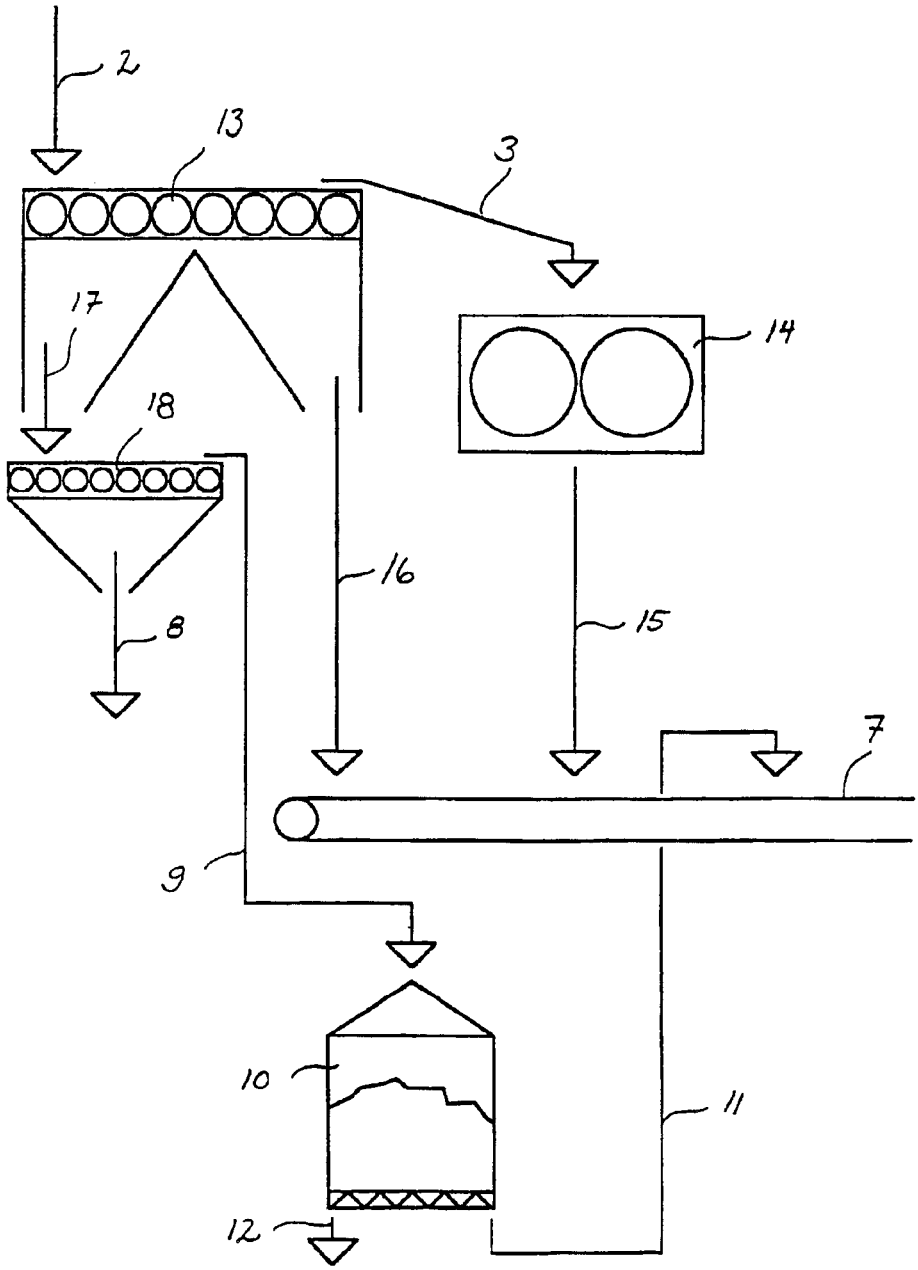
PRIOR ART Fig. 2
FIG. 2 shows a method of separating and dosing pin chips in connection with thickness screening.

In FIG. 2 is shown a thickness screening system wherein the large-size fraction 3, i.e. the chips that have crossed the first thickness screen 13, is led to a roller press 14. The chips 15 treated by the roller press are led directly to the subsequent process 7. The chips 16 that have penetrated the end part of the thickness screen are led directly to the subsequent process. The chips 17 that have penetrated the front part fall onto a sawdust screen 18. The particles 8 that have penetrated the sawdust screen are sawdust and are led to a burning process. The chips that have crossed the sawdust screen are pin chips 9 that are led into a pin bin and treated in the same way as in FIG. 1.

Figure 3:
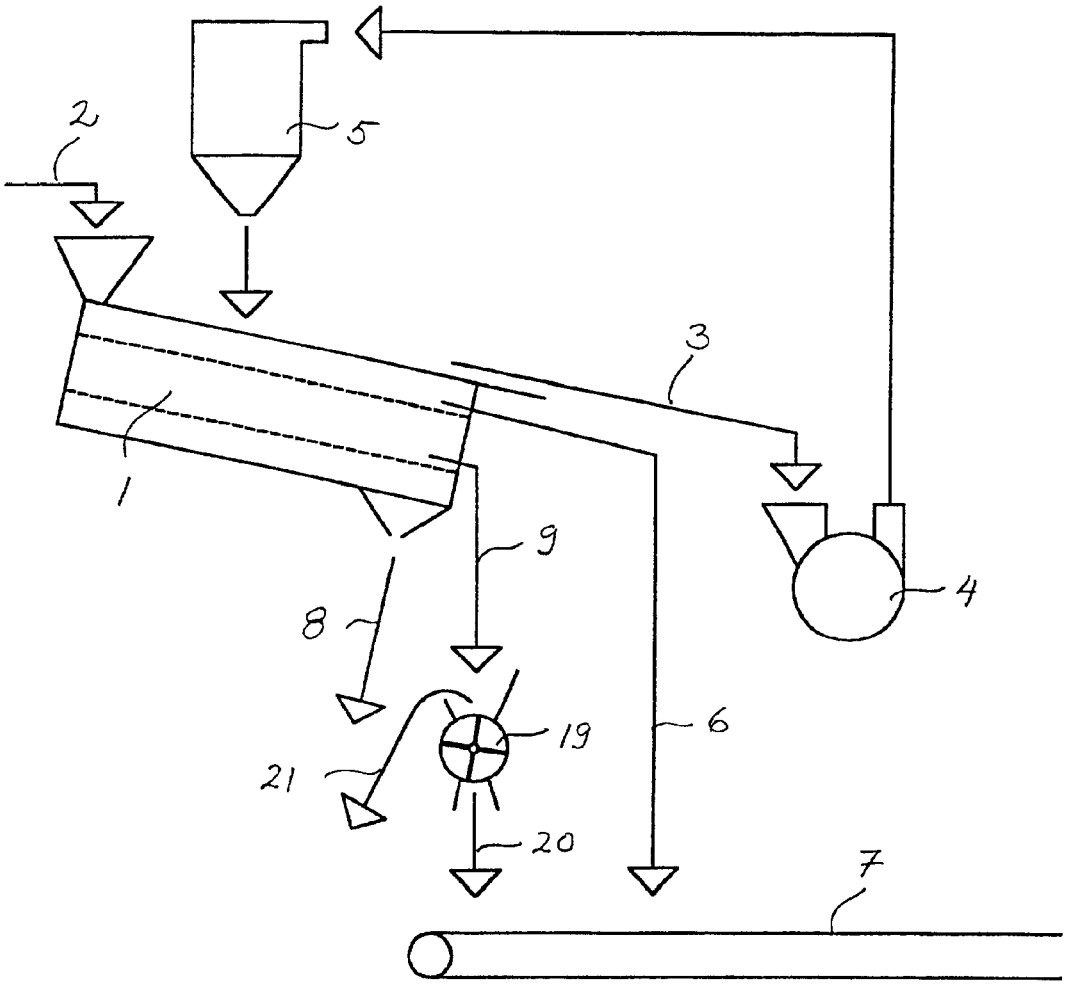
FIG. 3 shows the method of separating and dosing pin chips according to the invention using a flat screen.

FIG. 3 shows the pin chip dosing method according to the invention in connection with a flat screen. The pin chips 9 are led from the screen directly to a dosing apparatus 19 that doses only a certain amount 20 of pin chips into the subsequent process. The dosing apparatus 19 leads the surplus 21 of the pin chips among the sawdust 8. Alternatively, the surplus 21 of the pin chips is transported away from the screening plant, back to the chip pile, for example (if the variation in chip quality is only temporary), or, to a separate sawdust digesting process, for which the relevant pin fraction is excellent.

Figure 4:
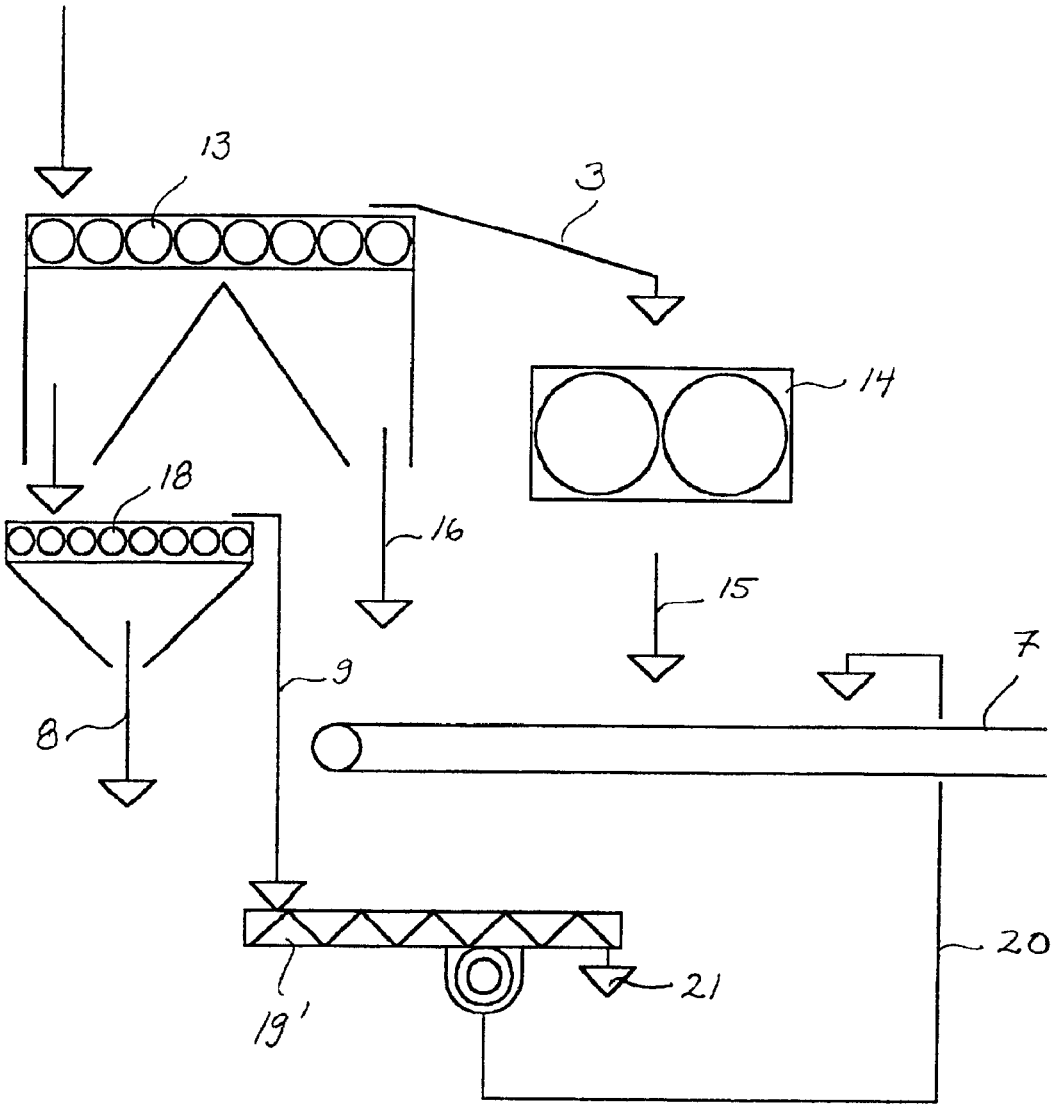
FIG. 4 shows the method of separating and dosing pin chips according to the invention in connection with thickness screening.

In FIG. 4, the pin chip dosing method according to the invention is used in a thickness screening system. Pin chips 9 coming from a sawdust screen 18 are led to a dosing apparatus 19' which, in this case, is constituted by two screw conveyors. The dosing apparatus 19' operates in the same way as the dosing apparatus shown in FIG. 3.

Figure 5:
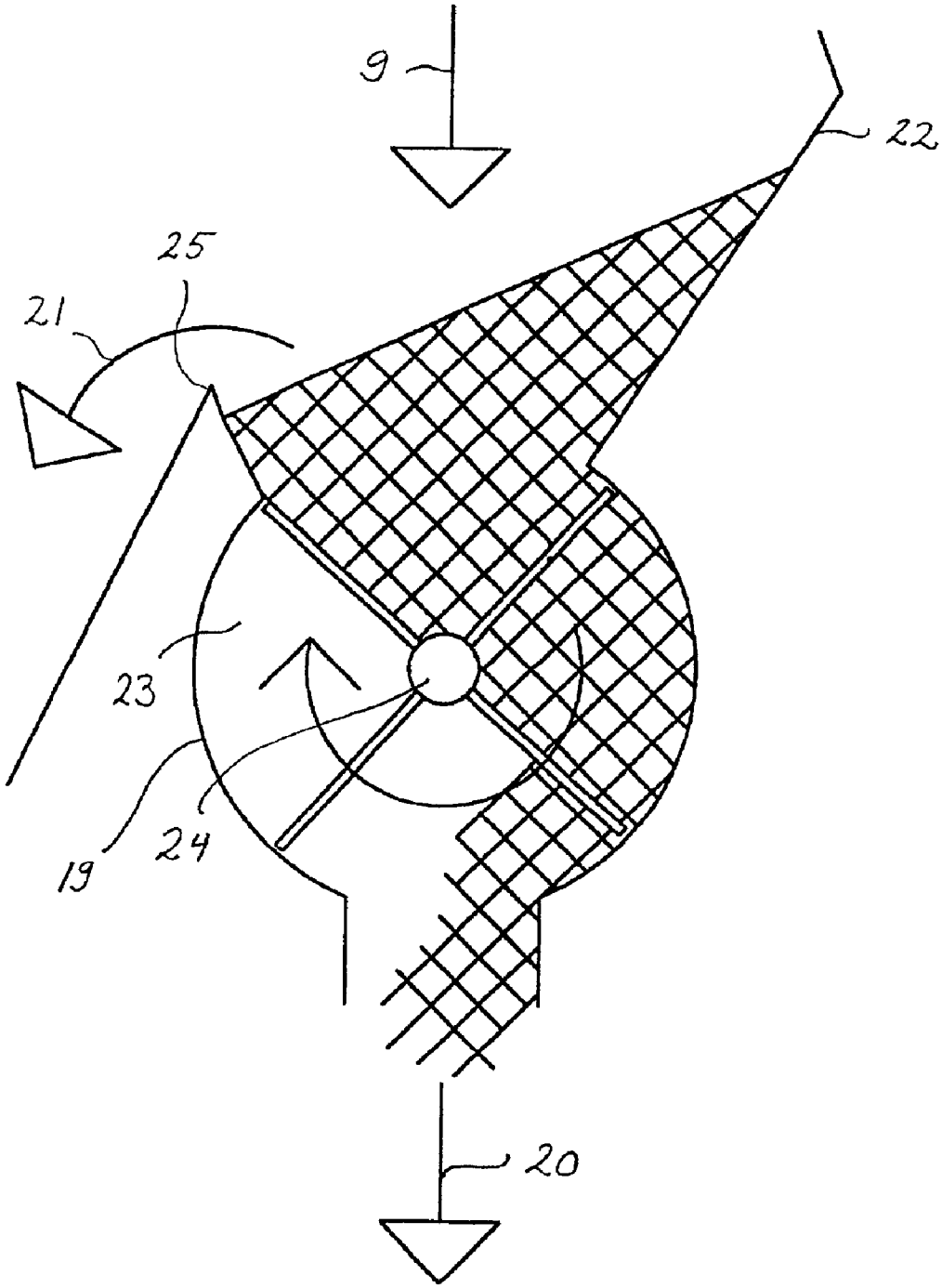
FIG. 5 shows the principles of the pin chip dosing method according to the invention in connection with a sectional feeder.

Said dosing can be performed by means of many kinds of devices that feed only a certain amount of pin chips among the accepted chips at a certain rate. The rest of the pin chips are led among the sawdust or away from the screening process, as desired. It is essential that the dosing apparatus is set for dosing the appropriate chip amount. Some of the most common ways of performing this kind of dosing are described in the following. In a socalled sectional feeder, for example, the pin chips are led into the feeding chute 22 of the sectional feeder 19 (FIG. 5). The dosing apparatus can be set to dose a desired amount 20 of pins into the subsequent process by adjusting the size of the sections 23 and the rate of rotation of the rotor 24. The rest 21 of the pin chips fall over the lower edge 25 of the feeding chute 22.

Figure 6:
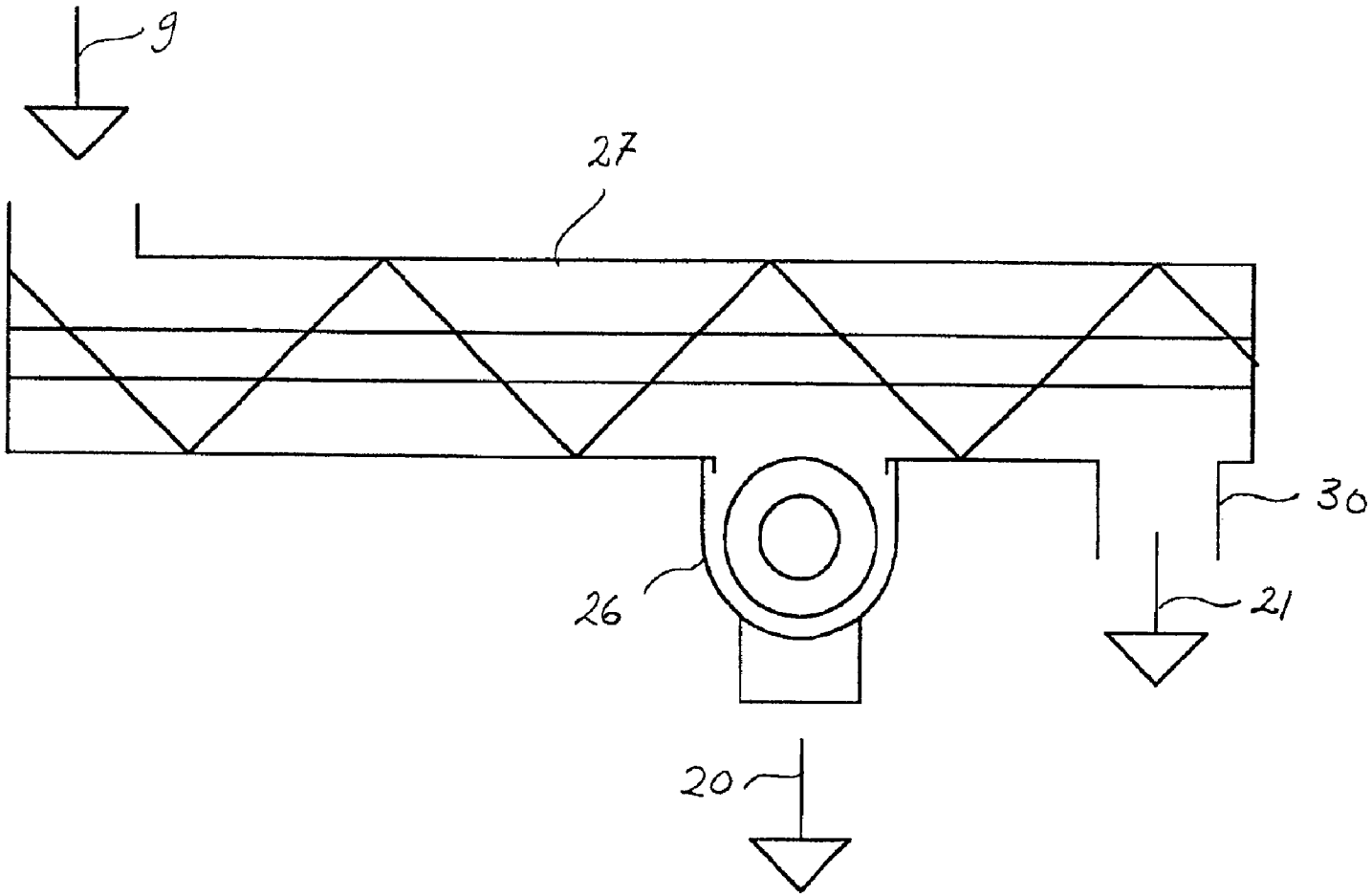
FIG. 6 shows a dosing screw and FIG. 7 shows the use of a scraper conveyor for the dosing.
Figure 7:
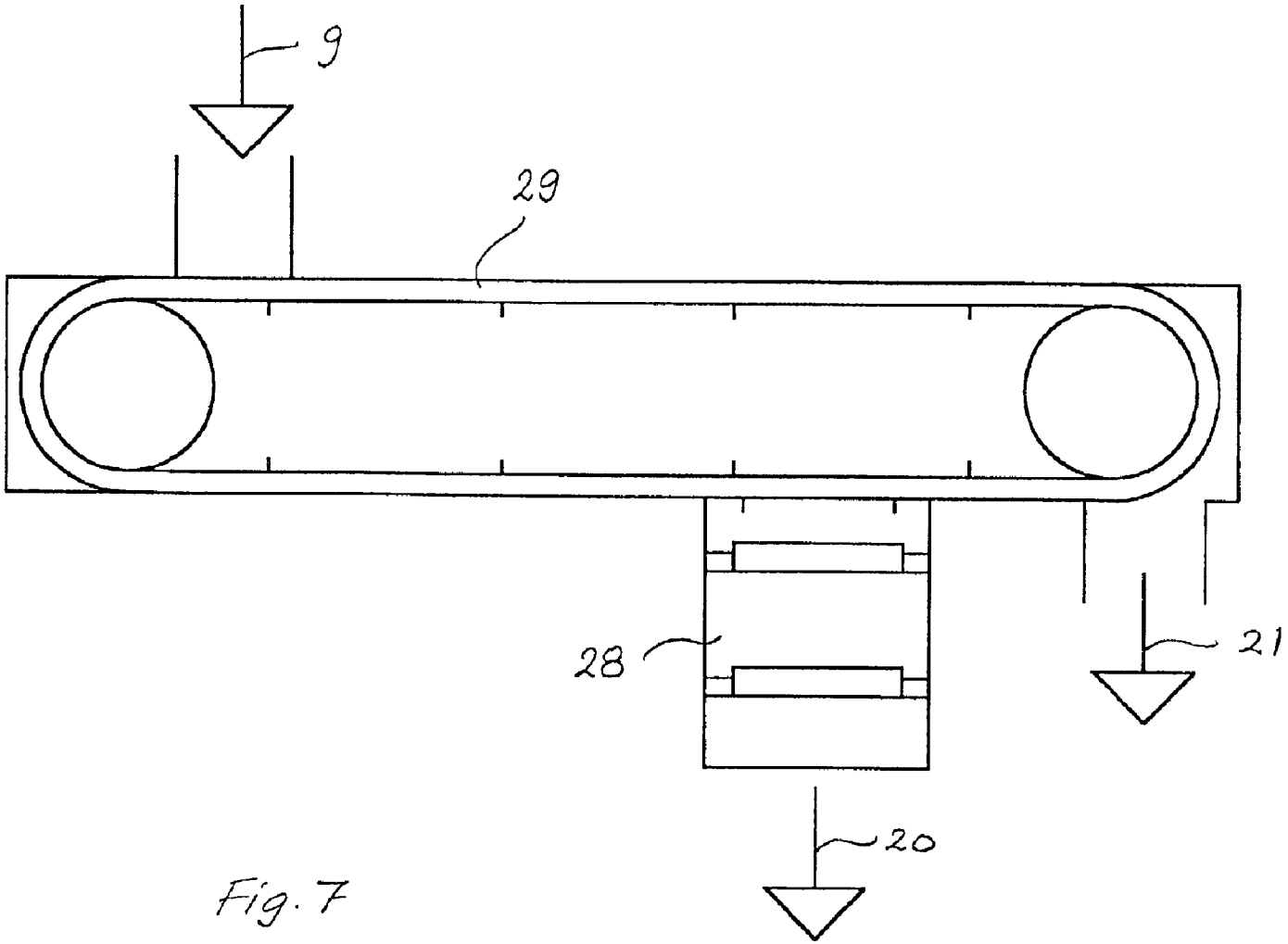

Correspondingly, dosing can be performed for example by means of two screw conveyors (FIG. 6). A desired amount of pin chips 20 is extracted by means of adjusting the speed of rotation of the lower screw conveyor 26. The upper screw conveyor 27 transports the rest 21 of the pin chips to a separate discharge opening 30 from which they are conducted, for example, among the sawdust. Dosing can be also performed by means of a scraper conveyor (FIG. 7), for example by adjusting the rate of speed of the lower scraper conveyor 28 to control the amount of pin chips 20 led into the subsequent process. It is also possible to place a screw conveyor under the scraper conveyor 29, to operate according to FIG. 6.

If the input of the screening process varies in quantity, the input or the output of the screening process can be measured and, correspondingly, the amount of pin chips led to the subsequent process can be adjusted. Thus, the ratio of the pin chips to the total amount of chips led to the subsequent process remains constant all the time. If the input of screening plant is constant, a constant amount of pin chips can be dosed. The term "pin chip" is defined, for example, in standard SCAN-CM 40:94.

What is claimed is:

1. A wood chip screening method comprising:

separating, in a separating apparatus, pin chips from a quantity of chips that are to be led to a subsequent process, providing a dosing apparatus comprising a rotatable device having a plurality of sections of adjustable size, and said rotatable device is adapted to adjust at least one of the rate of the rotation of said device and the size of said sections to control said desired amount of said pin chips and said desired rate of speed at which they are dosed among the chips that are to be led to the subsequent process, dosing a desired amount of the separated pin chips with the dosing apparatus at a desired rate of speed among the chips are to be led to a subsequent process so that a share of dosed pin chips relative to a total amount of chips does not exceed a desired value, while simultaneously directing pin chips in excess of said desired amount to a location different than said to be led to a subsequent process.

2. A chip screening method as defined in claim 1, comprising leading separated pin chips exceeding the desired amount of pin chips to a remote location.

3. A chip screening method as defined in claim 1, wherein the desired amount of pin chips dosed among the chips that are to be led to the subsequent process is a function of an amount of chips separated in the separating apparatus.

4. A chip screening method as defined in claim 1, wherein the desired amount of pin chips dosed among the chips that are to be led to the subsequent process is a function of an amount of chips fed into the subsequent process.

5. A plant for screening wood chips and for subsequently leading chips to a subsequent process comprising:

at least one separating apparatus adapted to separate pin chips from a quantity of chips to be led to a subsequent process; and a dosing apparatus arranged downstream of the separating apparatus and adapted to dose a desired amount of separated pin chips at a desired rate of speed among the chips that are to be led to the subsequent process upon the pin chips being separated by the separating apparatus, with pin chips in excess of said desired amount being simultaneously directed to a location different than said chips to be led to a subsequent process wherein said dosing apparatus comprises a rotatable device having a plurality of sections of adjustable size, and said rotatable device is adapted to adjust at least one of the rate of rotation of said rotatable device and the size of said sections to control said desired amount of said pin chips and said desired rate of speed at which they are dosed among the chips that are to be led to the subsequent process.

* * * * *